US007316306B2

(12) United States Patent
Ahn et al.

(10) Patent No.: US 7,316,306 B2
(45) Date of Patent: Jan. 8, 2008

(54) CURRENCY NOTE FEEDING APPARATUS FOR CURRENCY NOTE HANDLING MACHINE

(75) Inventors: Jin Hyuk Ahn, Gyunggi do (KR); Won Joon Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 181 days.

(21) Appl. No.: 11/125,105

(22) Filed: May 10, 2005

(65) Prior Publication Data

US 2006/0180977 A1 Aug. 17, 2006

(30) Foreign Application Priority Data

Dec. 24, 2004 (KR) ..... 10-2004-0112512

(51) Int. Cl.
*B65H 5/02* (2006.01)

(52) U.S. Cl. ..... 194/344; 271/272

(58) Field of Classification Search ..... 194/342, 194/343; 271/272

See application file for complete search history.

(56) References Cited

U.S. PATENT DOCUMENTS 4,750,730 A * 6/1988 Nilsson et al. ..... 271/96
5,377,805 A * 1/1995 Ono et al. ..... 194/206
6,019,210 A * 2/2000 Matsunaga et al. ..... 194/206

* cited by examiner

*Primary Examiner*—Patrick Mackey
*Assistant Examiner*—Mark J. Beauchaine
(74) *Attorney, Agent, or Firm*—Fish & Richardson P.C.

(57) ABSTRACT

Disclosed is a currency note feeding apparatus for a currency note handling machine capable of stably feeding currency note by use of a single belt guiding upper and lower surfaces of the currency note, and driving upper and lower belts of the single belt by use of one motor. The currency note feeding apparatus includes a currency note feeding belt assembly including an upper feeding belt coupled to a first drive pulley and a first following pulley for guiding an upper center of the currency note, and a lower feeding belt coupled to a second drive pulley and a second following pulley for guiding a lower center of the currency note, a drive unit coupled to a drive shaft of a drive motor for transferring driving of the motor to the first drive pulley and the second drive pulley, and a currency note feeding guide installed to both sides of the currency note feeding belt assembly and contacting with upper and lower surfaces of the currency note which is not contacted with the currency note feeding belt assembly to guide feeding of the currency note. The currency note feeding apparatus reduces costs of manufacturing the machine, and the feeding speed of the belt is easily controlled.

4 Claims, 5 Drawing Sheets

[Fig. 1]
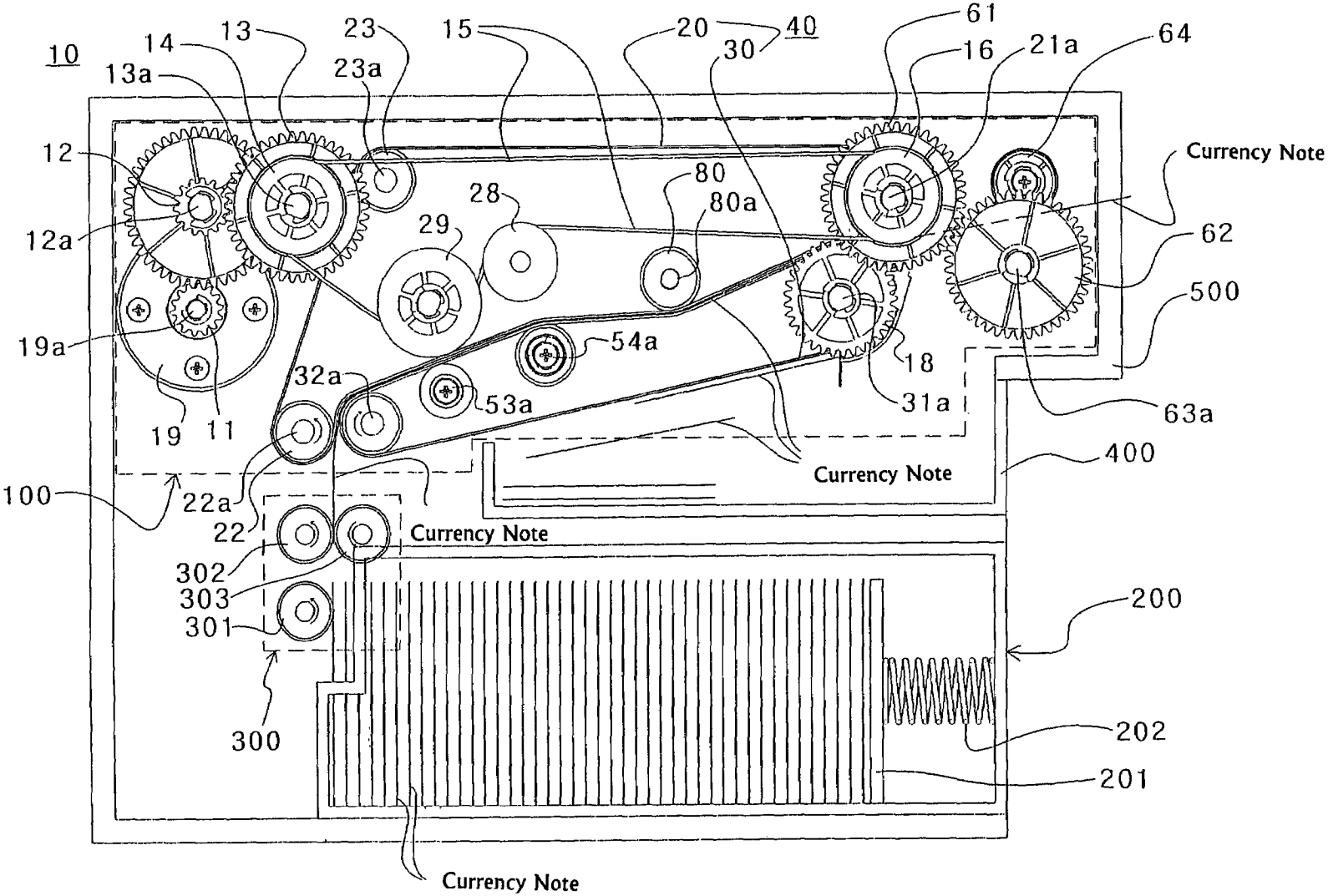

*[Fig. 2]*
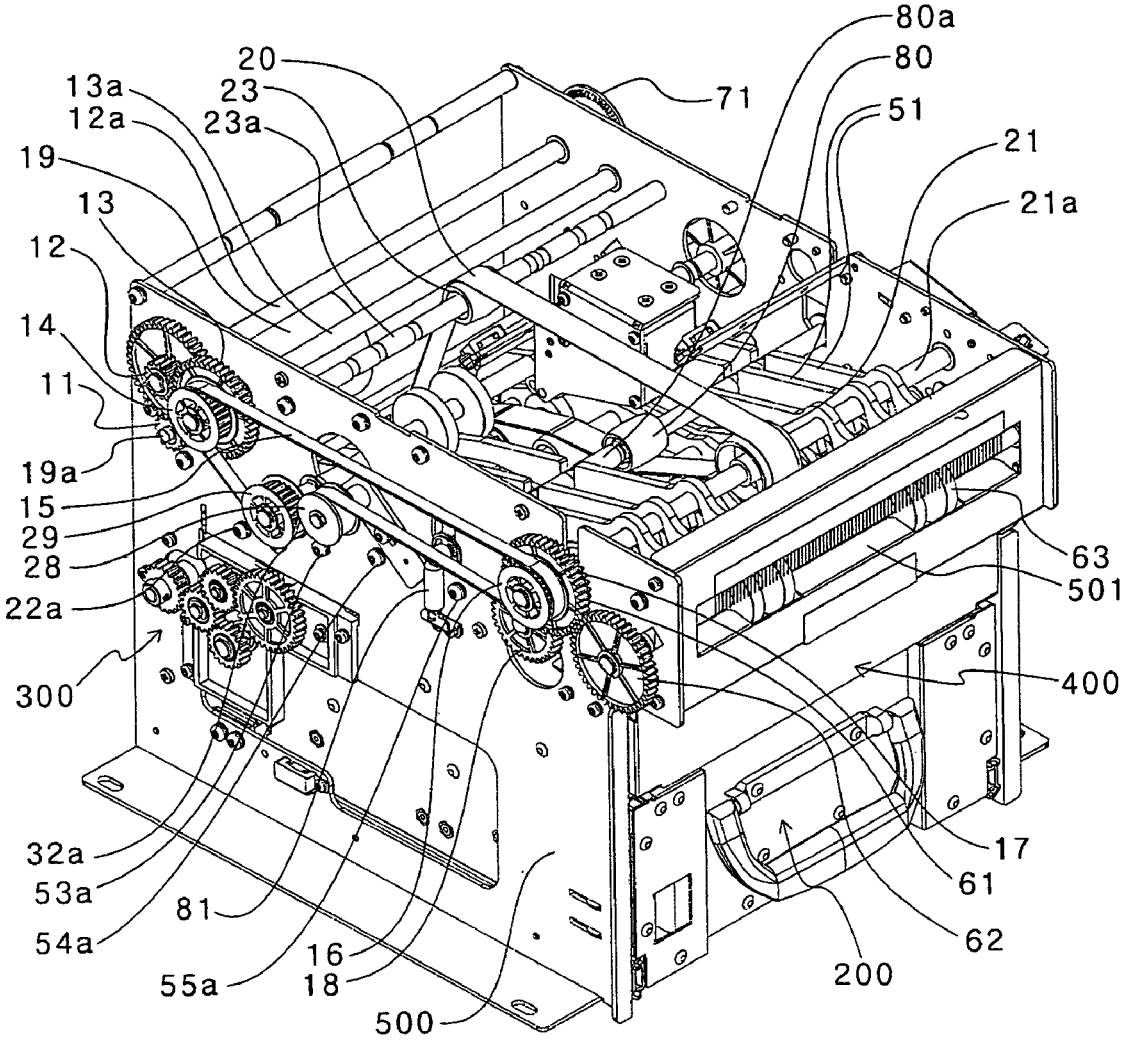

*[Fig. 3]*
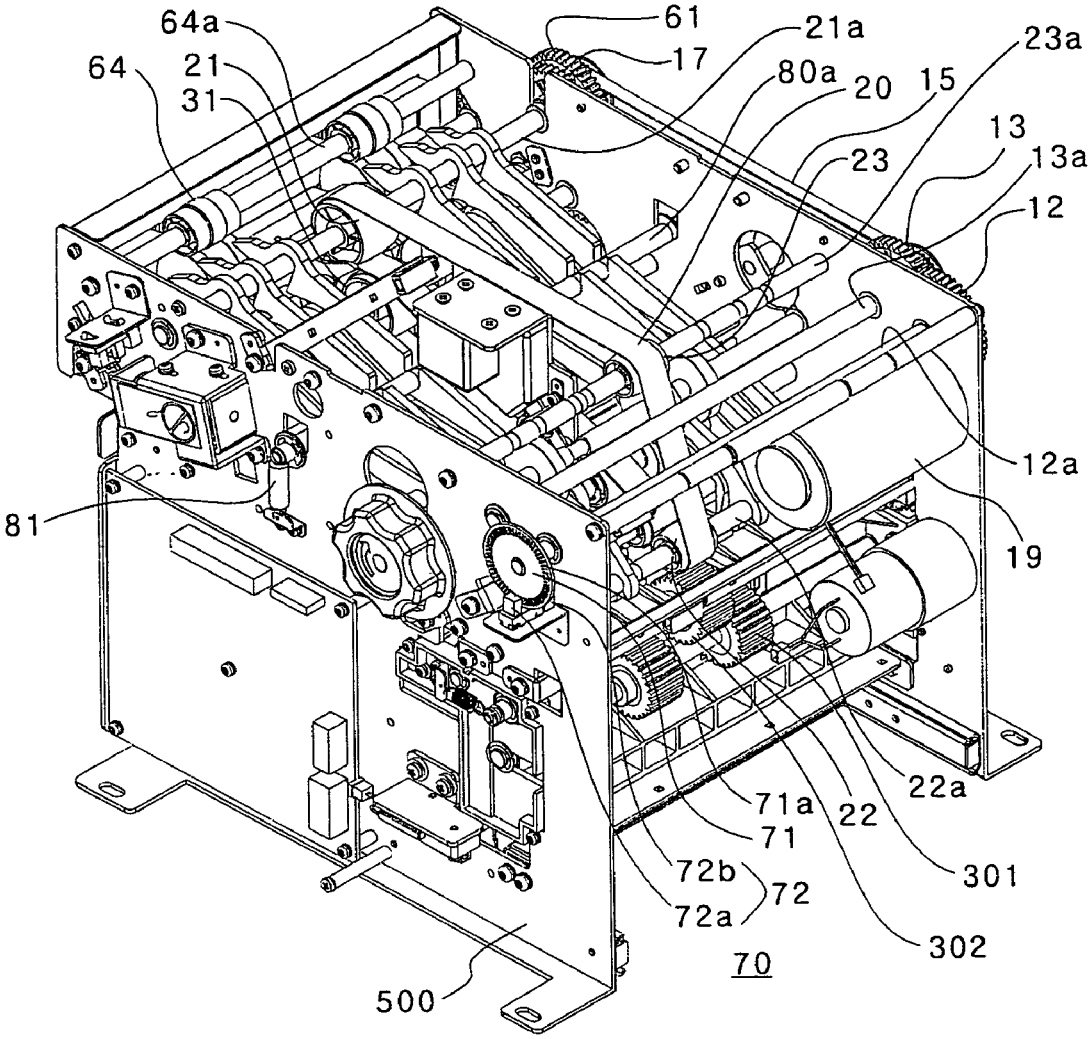

*[Fig. 4]*
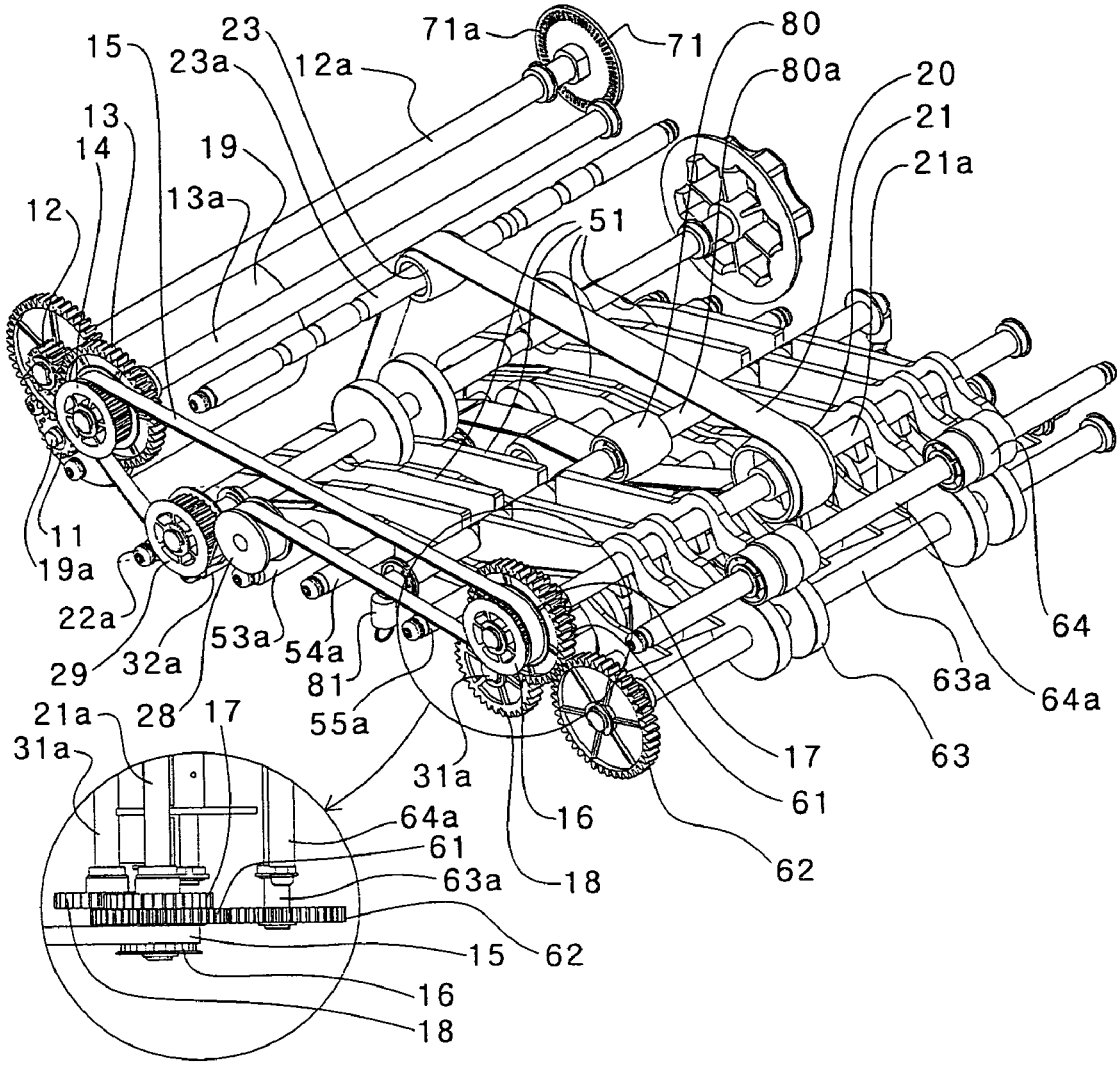

*[Fig. 5]*
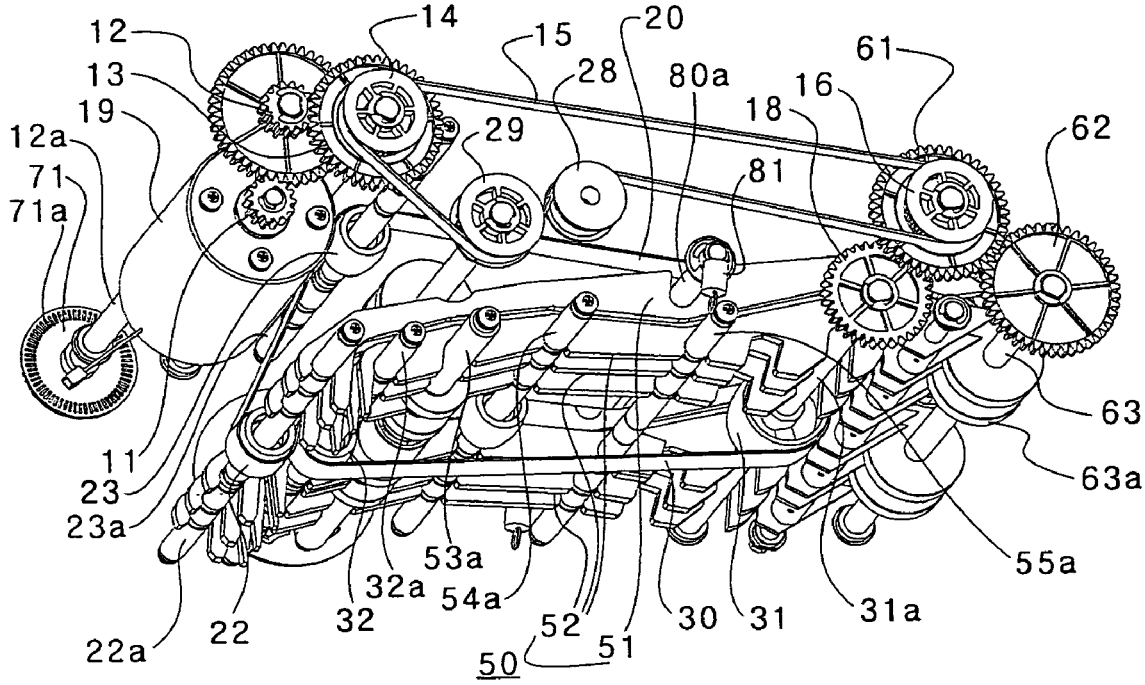

CURRENCY NOTE FEEDING APPARATUS FOR CURRENCY NOTE HANDLING MACHINE

CROSS-REFERENCE TO RELATED APPLICATIONS

This application claims priority under 35 USC 119 to Korean Patent Application No. 10-2004-0112512 filed on Dec. 24, 2004, the contents of which are incorporated herein by reference in its entirety.

BACKGROUND OF THE INVENTION

1. Field of the Invention

The present invention relates to a currency note feeding apparatus for a currency note handling machine, and more particularly to a currency note feeding apparatus for a currency note handling machine capable of stably feeding currency note by use of a single belt guiding upper and lower surfaces of the currency note, and driving upper and lower belts of the single belt by use of one motor to easily adjust a feed speed of the belt.

2. Description of the Prior Art

A currency note handling machine is referred to a machine for handling or carrying currency note, for example, an automatic teller machine (ATM) for depositing or dispensing the currency note at a cash corner.

The currency note handling machine generally includes a pickup roller for separating the paper sheet by sheet in a stacking space of currency note, and a feeding means, such as a belt or a feeding roller, for feeding a sheet of paper.

There are two types of currency note handling machine according to a feeding direction of the currency note: a horizontal currency note handling machine in which the currency note is fed in a horizontal direction (i.e., a short side) of the currency note; and a longitudinal currency note handling machine in which the currency note is fed in a longitudinal direction (i.e., a long side) of the currency note.

The horizontal currency note handling machine includes two or more rows of upper and lower belts at left and right sides relative to a center of the currency note to stably feed the currency note and thus prevent distortion of the currency note, since the currency note is fed in the horizontal direction. However, the belt utilized in the currency note handling machine is made in consideration of friction force between the currency note and the belt according to a kind of the currency note. The belt is significantly expensive relative to a common belt utilized in power transmission or conveyor. Nevertheless, since it has to use several expensive belts, the cost of currency note handling machine is increased.

In the case of the longitudinal currency note handling machine for a narrow width of currency note, the currency note can be stably fed by use of one row of single belt. If a width of the currency note is larger than a width of the belt, the longitudinal currency note handling machine has to utilize two or more rows of belts, as the horizontal currency note handling machine.

Also, the conventional horizontal/longitudinal currency note handling machines have the following disadvantages: first, two or more rows of belts have to be employed; second, since the belt is forcibly contacted with upper and lower surfaces of the currency note, an upper belt and a lower belt have to be provided; finally, since the upper and lower belts are driven by a drive motor, respectively, it is difficult to control the feeding speed of the currency note by controlling each drive motor.

SUMMARY OF THE INVENTION

Accordingly, the present invention has been made to solve the above-mentioned problems occurring in the prior art, and an object of the present invention is to provide a simple currency note feeding apparatus for a currency note handling machine capable of stably feeding currency note by use of a single belt guiding upper and lower surfaces of the currency note, and driving upper and lower belts of the single belt by use of one motor to easily adjust a feeding speed of the belt.

In order to accomplish this object, there is provided a currency note feeding apparatus for a currency note handling machine, comprising: a currency note feeding belt including an upper feeding belt coupled to a drive pulley of the upper feeding belt and a following pulley of the upper feeding belt for guiding an upper center of the currency note, and a lower feeding belt coupled to a drive pulley of the lower feeding belt and a following pulley of the lower feeding belt for guiding a lower center of the currency note; a drive unit coupled to a drive shaft of a drive motor for transferring driving of the motor to the drive pulley of the upper feeding belt and the drive pulley of the lower feeding belt; and a currency note feeding guide installed to both sides of the currency note feeding belt and contacting with upper and lower surfaces of the currency note which is not contacted with the currency note feeding belt to guide feeding of the currency note.

BRIEF DESCRIPTION OF THE DRAWINGS

The above and other objects, features and advantages of the present invention will be more apparent from the following detailed description taken in conjunction with the accompanying drawings, in which:

FIG. 1 is a schematic view of a cassette for a currency note handling machine according to an embodiment of the present invention;

FIG. 2 is a perspective view illustrating a front of a currency note handling machine;

FIG. 3 is a perspective view illustrating a rear of a currency note handling machine;

FIG. 4 is a perspective view illustrating a front of a currency note feeding apparatus for a currency note handling machine according to an embodiment of the present invention; and FIG. 5 is a perspective view illustrating a bottom of a currency note feeding apparatus for a currency note handling machine according to an embodiment of the present invention.

DETAILED DESCRIPTION OF THE PREFERRED EMBODIMENTS

Hereinafter, a preferred embodiment of the present invention will be described with reference to the accompanying drawings. In the following description and drawings, the same reference numerals are used to designate the same or similar components, and so repetition of the description on the same or similar components will be omitted.

FIG. 1 is a schematic view of a cassette for a currency note handling machine according to an embodiment of the present invention. FIG. 2 is a perspective view illustrating a front of the currency note handling machine. FIG. 3 is a perspective view illustrating a rear of the currency note handling machine. FIG. 4 is a perspective view illustrating a front of a currency note feeding apparatus for the currency note handling machine according to an embodiment of the present invention. FIG. 5 is a perspective view illustrating a bottom of the currency note feeding apparatus for the currency note handling machine according to an embodiment of the present invention.

Although the currency note feeding apparatus according to an embodiment of the present invention is mounted to a currency note dispensing machine, it may be applied to paper handling machines comprising printers for printing transaction particulars on paper, as well as currency note dispensing/depositing machines.

For example, the currency note dispensing machine mainly includes a cassette 200 filled with currency note, a sheet separating means 300 for separating the currency note stacked in the cassette 200 sheet by sheet, a currency note feeding apparatus 100 for depositing and feeding the currency note from the sheet separating means 200, and a withdrawing container 400 filled with currency note to be retrieved from the currency note feeding apparatus 100.

In the cassette 200 shown in FIG. 1, the currency note vertically stands up and stacks therein, with a longitudinal side contacting with a bottom surface of the cassette 200. When the currency note stacked as described above is separated and fed, the currency note is fed in a horizontal direction (i.e., a short side) of the currency note. Accordingly, the shown currency note dispensing machine is called as a horizontal currency note dispensing machine.

The cassette 200 includes a push plate 201 urged towards a pickup roller 301 of the sheet separating means 300 by a resilient member 202 and pushing a bundle of currency note towards one side to press the currency note against the pickup roller 301.

With the sheet separating means 300, the pickup roller 301 is contacted with an outer surface of the currency note to separate the currency note sheet by sheet, and a feed roller 302 and a gate roller 303 which are installed behind the sheet separate means feed the currency note separated by the pickup roller 301 to the feeding apparatus 100.

The currency note feeding belt assembly 40 of the currency note feeding apparatus 100 according to an embodiment of the present invention includes an upper feeding belt 20 coupled to a first drive pulley 21 and a first following pulley 22 for guiding an upper center of the currency note, and a lower feeding belt 30 coupled to a second drive pulley 31 and a second following pulley 32 for guiding a lower center of the currency note.

Preferably, the upper feeding belt 20 is provided with a tension roller 23 coupled to a rotary shaft 23*a* for applying tension to the upper feeding belt.

The first drive pulley 21 rotating the upper feeding belt 20 and the second drive pulley 31 rotating the lower feeding belt 30 are connected to a drive unit 10 consisting of plural gears, pulleys and rotary shafts, such that the currency note feeding belt assembly 40 is supplied with a rotary force from a drive motor 19 to feed the currency note.

The drive unit 10 for the currency note feeding belt assembly 40 includes a first drive gear 11 coupled to a drive shaft 19*a* of the drive motor 19, a second drive gear 13 meshed with the first drive gear 11 and coupled to a rotary shaft 13*a*, a third drive pulley 14 coupled to one side of the second drive gear 13, a drive belt 15 coupled to one side of the third drive pulley 14, a third following pulley 16 coupled to the other side of the drive belt 15, a rotary shaft 21*a* coupled to the third following pulley 16 and the first drive pulley 21, a following gear 17 coupled to one side of the third following pulley 16, a third drive gear 18 meshed with the following gear 17, and a rotary shaft coupled to the third drive gear 18 and the second drive pulley 31.

Preferably, the drive belt 15 is provided with a first tension roller 28 and a second tension roller 29 to maintain a tension state.

With the above construction, the rotary force produced from the drive motor 19 is transferred in order of the first drive gear 11, the second drive gear 13, the third drive pulley 14, the drive belt 15, the third following pulley 16, a following gear 17, and the third drive gear 18.

In particular, the following gear 17 coupled to one side of the a gear 61 for transferring a power to a dispensing section is coupled to one end of the rotary shaft 21*a* of the first drive pulley 21 for driving the upper feeding belt 20, thereby transferring the driving force from the drive motor 19 to the first drive pulley 21 and the upper feeding belt 20.

The following gear 17 is meshed with the third drive gear 18 coupled to one end of the rotary shaft 31*a* of the second drive pulley 31 for driving the lower feeding belt 30, thereby transferring the driving force from the drive motor 19 to the second drive pulley 31 and the lower feeding belt 30.

An intermediate gear 12 is coupled to a rotary shaft 12*a* for installing a speed sensing unit 70 for sensing speed of the currency note feeding belt. Although the first drive gear 11 is indirectly meshed with the second drive gear 13 through the intermediate gear 12 in the accompanying drawings, the first drive gear 11 may be directly meshed with the second drive gear 13, without using the intermediate gear 12.

The rotating direction of the drive motor 19 may be changed according to provision of the intermediate gear 12.

Specifically, in the case where the intermediate gear 12 is provided to install the speed sensing unit 70, as shown in the accompanying drawings, the drive motor 19 has to be rotated in a counterclockwise direction, so that the currency note feeding belt assembly 40 is rotated in a dispensing direction of the currency note. In the case where the intermediate gear 12 is not provide and the first drive gear 11 is directly meshed with the second drive gear 13, however, the drive motor 19 has to be rotated in a clockwise direction, so that the currency note feeding belt assembly 40 is rotated in the dispensing direction of the currency note.

With the construction, since the upper feeding belt 20 and the lower feeding belt 30 are operated by one drive motor 19, it is easy to adjust the feeding speed of the currency note by regulating the speed of the upper and lower feeding belts 20 and 30.

Since the currency note feeding belt assembly 40 is one row of single belt for guiding upper and lower center surfaces of the currency note, the upper and lower surfaces of the upper and lower feeding belts 20 and 30 which are not contacted with the currency note are provided with a currency note feeding guide assembly 50 to prevent the distortion of the currency note when feeding.

The currency note feeding guide assembly 50 includes an upper guide 51 installed to left and right sides of the upper feeding belt 20, of which a bottom is secured to the rotary shaft 21*a* and the rotary shaft 22*a*, and a lower guide 52 installed to left and right sides of the lower feeding belt 30, of which a bottom is secured to the rotary shaft 31*a*, the rotary shaft 32*a*, a first support shaft 53*a* of the lower guide 52, a second support shaft 54*a* of the lower guide, and a third support shaft 55*a* of the lower guide.

The problem that the currency note is distorted by use of the one row of single belt can be solved by the currency note feeding guide assembly 50.

The drive unit 10 for the currency note feeding belt assembly 40 includes the gear 61 for transferring the power of the drive motor 19 to a dispensing roller 63 guiding the currency note fed from the currency note feeding belt assembly 40, without installing a separate drive motor, and a fourth drive gear 62 meshed with the gear 61 and coupled to the rotary shaft 63*a* of the dispensing roller 63 for guiding the currency note fed by the currency note feeding belt assembly 40. The gear 61 is coupled to one side of the following gear 17 for the drive belt, as shown in FIG. 4, to form two row gears.

Preferably, the dispensing roller 63 is provided with a pinch roller 64 coupled to a rotary shaft 64*a* of the pinch roller so that the currency note is forcibly contacted with a lower surface of the dispensing roller 63 and is dispensed to dispensing port 101 of the main frame 100 shown in FIG. 2.

The speed sensing unit 70 senses the speed of the currency note feeding belt assembly 40 in connection with the drive shaft 19*a* of the drive motor 19.

The speed sensing unit 70 may be installed to the drive shaft 19*a* of the drive motor 19. Since a diameter of the drive shaft 19*a* is small and is rotated at high speed, it is difficult to measure the speed of the currency note feeding belt assembly 40. Preferably, the speed sensing unit 70 is installed to the rotary shaft 12*a* of the intermediate gear to obtain a reduction ration.

Specifically, the speed sensing unit 70 includes the intermediate gear 12 installed between the first drive gear 11 and the second drive gear 13, the rotary shaft 12*a* coupled to the intermediate gear 12, an encoder 71 coupled to the rotary shaft 12*a* and formed with a plurality of slits 71*a* at an edge of a disk, and a sensor 72 consisting of a light emitting portion 72*a* and a light receiving portion 72*b* which are opposite to front and rear surfaces of the slit 71*a* of the encoder.

The sensor 72 detects as a light if the light emitted from the light emitting portion 72*a* is incident on the light receiving portion 72*b* through the slit 71*a*, while detects as a dark if the light emitted from the light emitting portion 72*a* is intercepted by a portion between the slits 71*a* and thus is not incident on the light receiving portion 72*b*. When the encoder 71 rotates together with the drive shaft 19*a* of the drive motor 19, the sensor 72 detects the number of the light thereby to measure the number of slits 71*a* during a desired time.

The speed sensing unit 70 includes a controller (not shown) for receiving the detected signal from the sensor 72 to determine the feeding speed of the currency note feeding belt assembly 40 and for controlling the rotary speed of the drive motor 19 if the feeding speed exceeds or does not exceed a predetermined value.

The controller compares the number of slits 71*a* detected during the desired time with a reference value to determine the feeding speed.

The upper feeding belt 20 is provided with a pressing roller for pressing or releasing the upper feeding belt 20 against the lower feeding belt 30.

A pressing roller 80 is provided on a feeding path of the currency note in the upper feeding belt 20 to press the upper feeding belt 20 against the lower feeding belt 30.

The pressing roller 80 is axially coupled to the rotary shaft 80*a* of the pressing roller rotatably supported by both sides of the main frame 100, and is biased by the resilient member 81 having one end secured to the main frame 100 and the other end coupled to the rotary shaft 80*a* of the pressing roller, thereby causing the upper feeding belt 20 to be pressed against the lower feeding belt 30.

The pressing roller 80 controls a pressed degree of the currency note between the upper and lower feeding belts 20 and 30, or releases the resilient member 81 when the currency note is jammed between the upper and lower feeding belts 20 and 30. In the later case, an operator can remove the currency note by slightly lifting up the upper guide 51 and the upper feeding belt 20.

With the above description, since the currency note feeding apparatus stably feeds the currency note by use of the single belt, costs of manufacturing the machine may be reduced. In addition, since the paper feeding belt is driven by use of one motor, the feeding speed of the belt may be easily controlled. Also, the feeding speed of the belt is easily measured by the speed sensing unit.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A currency note feeding apparatus for a currency note handling machine, comprising:

a currency note feeding belt assembly including an upper feeding belt coupled to a first drive pulley for the upper feeding belt and a first following pulley for the upper feeding belt for guiding an upper center of the currency note, and a lower feeding belt coupled to a second drive pulley for the lower feeding belt and a second following pulley for the lower feeding belt for guiding a lower center of the currency note;

a drive unit for the currency note feeding belt assembly, which is coupled to a drive shaft of a drive motor for transferring driving of the motor to the first drive pulley for the upper feeding belt and second the drive pulley for the lower feeding belt; and a currency note feeding guide assembly including upper guides installed to opposite sides of the upper feeding belt and contacting with upper surface of the currency note which is not contacted with the currency note feeding belt assembly to guide feeding of the currency note into the currency note feeding belt assembly, and lower guides installed to opposite sides of the lower feeding belt and contacting with lower surface of the currency note which is not contacted with the currency note feeding belt assembly to guide feeding of the currency note into the currency note feeding belt assembly, wherein the drive unit for the currency note feeding belt assembly includes:

a first drive gear coupled to the drive shaft of the drive motor, a second drive gear meshed with the first drive gear, a third drive pulley coupled to one side of the second drive gear, a drive belt coupled to the third drive pulley, a third following pulley for the drive belt, which is coupled to the drive belt, a rotary shaft for the upper feeding belt, which is coupled to the third following pulley and the first drive pulley, a following gear for the drive belt, which is coupled to one side of the third following pulley, a third drive gear for the lower feeding belt, which is meshed with the following gear for the drive belt, and a rotary shaft for the lower feeding belt, which is coupled to the third drive gear and the second drive pulley, in which a power is transferred to the upper feeding belt and the lower feeding belt by the drive motor.

2. The currency note feeding apparatus according to claim 1, wherein the drive unit for the currency note feeding belt assembly includes:

a gear coupled to one side of the following gear for the drive belt for transferring the power of the drive motor to a dispensing section, and a fourth drive gear meshed with the gear and coupled to a rotary shaft of a dispensing roller for guiding the currency note fed by the currency note feeding belt assembly.

3. The currency note feeding apparatus according to claim 1, wherein the upper feeding belt is provided with a pressing roller for pressing or releasing the upper feeding belt against the lower feeding belt.

4. The currency note feeding apparatus according to claim 1, further comprising a speed sensing unit for sensing speed of the currency note feeding belt in connection with the drive shaft of the drive motor.

* * * * *